US005325796A

United States Patent [19]

Garcia-Mallol

[11] Patent Number: 5,325,796

[45] Date of Patent: Jul. 5, 1994

[54] PROCESS FOR DECREASING $N_2O$ EMISSIONS FROM A FLUIDIZED BED REACTOR

[75] Inventor: Juan A. Garcia-Mallol, Morristown, N.J.

[73] Assignee: Foster Wheeler Energy Corporation, Clinton, N.J.

[21] Appl. No.: 886,892

[22] Filed: May 22, 1992

[51] Int. Cl.[5] ..... F22B 1/02

[52] U.S. Cl. ..... 110/245; 122/4 D

[58] Field of Search ..... 432/58; 122/4 D; 110/245

[56] References Cited

U.S. PATENT DOCUMENTS

| | | | |
|---|---|---|---|
| 4,039,621 | 8/1977 | Costantini . | |
| 4,084,545 | 4/1978 | Nack et al. . | |
| 4,308,810 | 1/1982 | Taylor . | |
| 4,435,148 | 3/1984 | Moss . | |
| 4,602,573 | 7/1986 | Tanca . | |
| 4,704,084 | 11/1987 | Liu et al. . | |
| 4,708,067 | 11/1987 | Narisoko et al. . | |
| 4,716,844 | 1/1988 | Koch . | |
| 4,773,339 | 9/1988 | Garcia-Mallol . | |
| 4,809,625 | 3/1989 | Garcia-Mallol et al. . | |
| 4,936,770 | 6/1990 | Abdulally . ' | |
| 4,955,295 | 9/1990 | Abdulally | 110/245 |
| 4,962,711 | 10/1990 | Yamauchi et al. | 110/245 |
| 5,020,456 | 6/1991 | Khinkis et al. . | |
| 5,141,708 | 8/1992 | Campbell, Jr. | 110/245 |

FOREIGN PATENT DOCUMENTS

| | | |
|---|---|---|
| WO9105205 | 4/1991 | Fed. Rep. of Germany . |
| 52-39834 | 3/1977 | Japan . |
| 53-146326 | 12/1978 | Japan . |
| 54-42868 | 4/1979 | Japan . |
| 54-61330 | 5/1979 | Japan . |
| 54-88673 | 7/1979 | Japan . |
| 63-279013 | 11/1988 | Japan . |

OTHER PUBLICATIONS

G. Hammons and A. Skopp, $NO_X$ Formation and Control in Fluidized Bed Coal Combustion Processes, ASME Publication (Nov.-Dec. 1971).

L. Amand and S. Andersson, Emissions of Nitrous Oxide ($N_2O$) from Fluidized Bed Boilers, 1989 Int'l Conf. on FBC.

A. Braun, U. Renz, J. Drischel, and H. Koser, $N_2O$- and $NO_X$ emissions from a fluidized bed combustor, Wirbelschict-Systeme—Conf. 1990.

L. Gustavsson and B. Leckner, $N_2O$ Reduction With Gas Injection in Circulating Fluidized Bed Boilers, 1991 Intl. Conf. on FBC.

M. Hiltunen, P. Kilpinen, M. Hupa, and Y. Lee, $N_2O$ Emissions From CFB Boilers: Experimental Results and Chemical Interpretation, 1991 Int'l Conf. on FBC.

T. Shimizu, Y. Tachiyama, M. Souma, and M. Inagaki, Emission Control of $NO_X$ and $N_2O$ of Bubbling Fluidized Bed Combustor, 1991 Int'l Conf. on FBC.

E. Bramer and M. Valk, Nitrous Oxide and Nitric Oxide Emissions by Fluidized Bed Combustion, 1991 Int'l Conf. on FBC.

(List continued on next page.)

*Primary Examiner*—Henry C. Yuen

*Attorney, Agent, or Firm*—Marvin A. Naigur

[57] ABSTRACT

Emissions of nitrous oxide ($N_2O$) are lowered in a fluidized bed reactor utilizing two-staged combustion. A lower region of the furnace section is operated under substoichiometric conditions so that combustion in the lower region is incomplete, thereby inhibiting formation of $N_2O$ and nitrogen oxides ($NO_x$). An upper region of the furnace section is operated under oxidizing conditions to promote further combustion. An amount of particulate material is present in the upper region, and this amount of particulate material in the upper region is controlled to maintain a temperature in the upper region for destroying $N_2O$ formed during combustion. The amount of particulate material present in the upper region may in turn be controlled by controlling the particulate material entrained from the lower region to the upper region. The temperature is also preferably controlled within a range to permit sulfur capture by sorbent particles so that emissions of $N_2O$, $NO_x$, and oxides of sulfur ($SO_x$) may be simultaneously lowered.

30 Claims, 1 Drawing Sheet

OTHER PUBLICATIONS

A. Braun, C. Bu, U. Renz, J. Drischel, and H. Koser, Emission of NO and $N_2O$ From a 4 MW Fluidized Bed Combustor With NO Reduction, 1991 Int'l Conf. on FBC.

A. Brown and L. Muzio, $N_2O$ Emissions From Fluidized Bed Combustion, 1991 Int'l Conf. on FBC.

A. Jahkola, Y. Lu, and I. Hippinen, The Emission and Reduction of $NO_x$ and $N_2O$ in PFB-Combustion of Peat and Coal, 1991 Int'l Conf. on FBC.

I. Cabrita, M. Costa, H. Esparteiro, and I. Gulyurtlu, Determination of Overall Fuel-N Balance During Fluidised Bed Coal Combustion, 1991 Int'l Conf. on FBC.

T. Hulgaard, P. Glarborg, and K. Dam-Johansen, Homogeneous Formation and Destruction of $N_2O$ at Fluidized Bed Combustion Conditions, 1991 Int'l Conf. on FBC.

H. Miettinen, D. Stromberg, and O. Lindquist, The Influence of Some Oxide and Sulphate Surfaces on $N_2O$ Decomposition, 1991 Int'l Conf. on FBC.

H. Moritomic, Y. Suzuki, N. Kido, and Y. Ogisu, $NO_X$ Formation Mechanism of Circulating Fluidized Bed Combustion, 1991 Int'l Conf. on FBC.

M. Wojtowicz, J. Lohuis, P. Tromp, and J. Moulijn, $N_2O$ Formation in Fluidised-Bed Combustion of Coal, 1991 Int'l Conf. on FBC.

P. Wallman, E. Ivarsson, and R. Carlsson, $NO_X$ and $N_2O$ Formation in Pressurized Fluidized-Bed Combustion Tests, 1991 Int'l Conf. on FBC.

K. Iisa, P. Salokoski, and M. Hupa, Heterogeneous Formation and Destruction of Nitrous Oxide Under Fluidized Bed Combustion Conditions, 1991 Int'l Conf. on FBC.

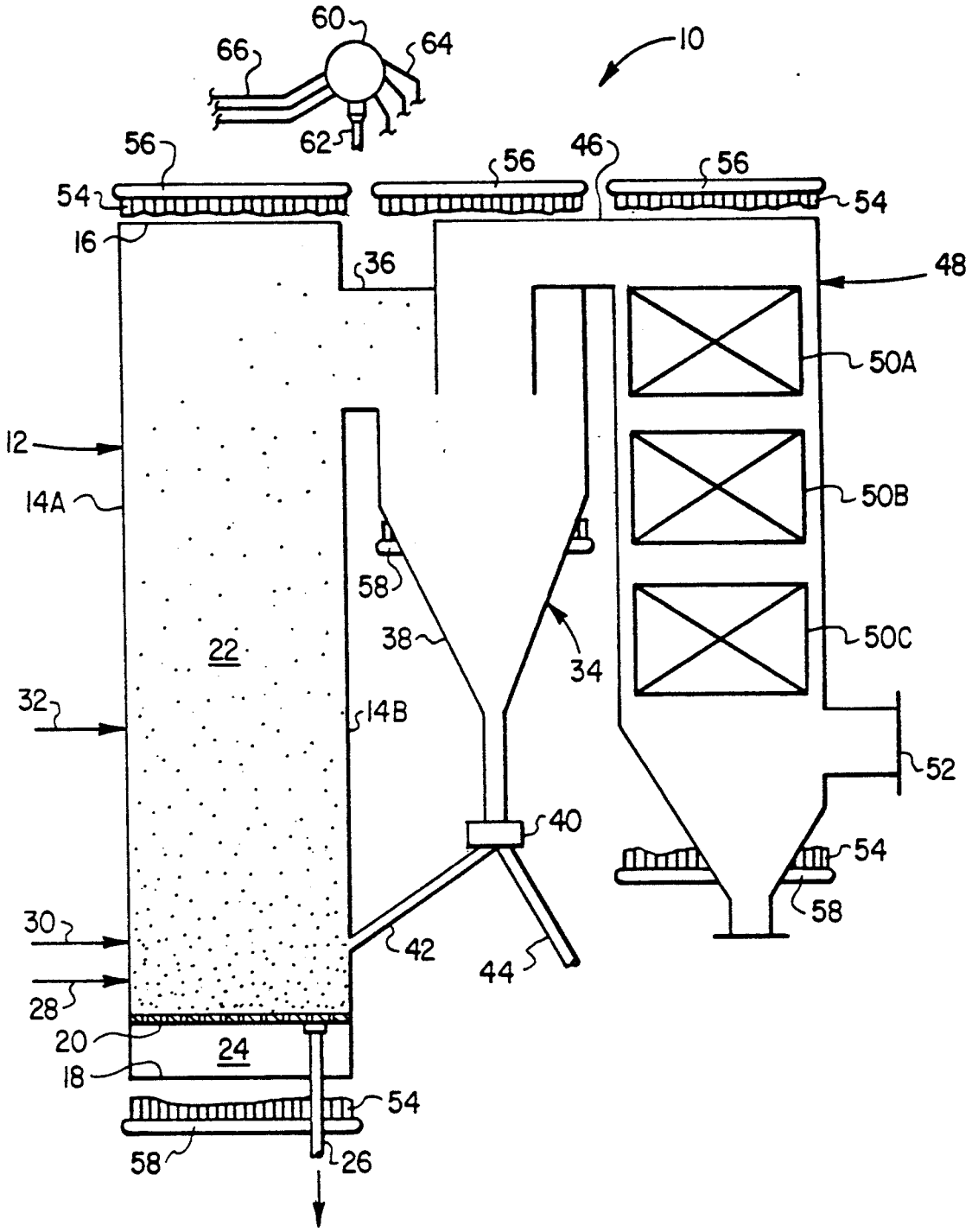
60
66
64
10
62
56
46
56
56
54
54
16
36
48
50A
12
50B
14A
58
38
50C
22
34
32
14B
52
40
54
58
30
42
44
28
20
24
18
54
58
26

PROCESS FOR DECREASING $N_2O$ EMISSIONS FROM A FLUIDIZED BED REACTOR

BACKGROUND OF THE INVENTION

This invention relates to a method of operating a fluidized bed reactor to decrease emissions of nitrous oxide ($N_2O$) while maintaining efficient sulfur capture in the reactor.

Fluidized bed combustion systems are well known and include a furnace section in which a primary, oxygen-containing gas, such as air, is passed through a bed of particulate material, including nitrogen-containing, carbonaceous fuel particles such as coal, sorbent particles, such as limestone, lime, or dolomite, for the capture of oxides of sulfur generated by the combustion of the coal, and solid products of combustion. The primary gas fluidizes the particulate material in the furnace section and promotes the combustion of the fuel particles at a relatively low temperature. These types of combustion systems are often used in steam generators in which a cooling fluid, such as water, is passed through a fluid flow circuit in a heat exchange relationship to the fluidized bed reactor to generate steam and permit high combustion efficiency and fuel flexibility, high sulfur adsorbtion and low nitrogen oxides ($NO_x$) emissions.

A typical fluidized bed reactor utilized in the generation of steam is commonly referred to as a "bubbling" fluidized bed in which the fluidized particulate material forms a bed having a relatively high density and a well-defined, or discrete, upper surface. A more commonly used fluidized bed reactor is referred to as a "circulating" fluidized bed in which the fluidized particulate material forms a lower dense bed having a density below that of a typical bubbling fluidized bed and in which the primary gas has a fluidizing velocity which is equal to or greater than that of a bubbling bed. The primary gas passing through the lower dense bed entrains a substantial amount of fine particulate material to form an upper dispersed bed of particulate material, often to the extent that the primary gas is substantially saturated with the particulate material in the dispersed bed.

It is generally considered desirable to operate these circulating fluidized beds using relatively high internal and external solids recycling so that they are insensitive to fuel heat release patterns, thus minimizing temperature variations and stabilizing the sulfur emissions at a low level. The high external solids recycling is achieved by disposing a separator such as a cyclone separator at the furnace section outlet to receive the flue gases, and the particulate material entrained thereby, from the dispersed bed of the furnace section. The entrained particulate material is separated from the flue gases in the separator, and the cleaned flue gases are passed to a heat recovery section while the separated particulate material is recycled back to the furnace section. This recycling improves the efficiency of the separator, and the increased residence times of the fuel and sorbent particles result in more efficient use of the fuel and sorbent particles and, therefore, reduced consumption of the same.

Bubbling and circulating fluidized bed reactors also offer advantages in pollution control. For example, the emissions of $NO_x$ from fluidized bed reactors are relatively low compared to emissions from other conventional systems such as gas-fired systems and coal-fired power plants. Staged combustion in fluidized bed reactors permits even lower $NO_x$ emission levels to be achieved. Methods of operating a fluidized bed reactor using staged combustion to lower emissions of $NO_x$ are disclosed in U.S. Patent Nos. 4,308,810 and 4,773,339, both assigned to the assignee of the present invention, the disclosures of which are hereby incorporated by reference.

However, fluidized beds are not without problems. For example, there has been recent concern regarding the emissions of $N_2O$ from fluidized bed reactors. It has been discovered that $N_2O$ may act as an ozone layer scavenger, and $N_2O$ is not readily broken down once released to the atmosphere. Currently, emissions of $NO_x$ and oxides of sulfur ($SO_x$) are legislatively regulated and, in light of the adverse effects of $N_2O$ on the ozone layer, it is likely that emissions of $N_2O$ will also be regulated soon.

It has also been recently discovered that, although emissions of $NO_x$ by circulating fluidized bed reactors are relatively low compared to other conventional combustors, emissions of $N_2O$ by circulating fluidized bed reactors can be significant. For example, $N_2O$ emission levels from circulating fluidized bed reactors may typically be within the range of 50–200 ppm, whereas $N_2O$ emission levels from boilers equipped with other devices may typically be within the range of 1–20 ppm. It is therefore important to reduce the emissions of $N_2O$ from circulating fluidized bed reactors while simultaneously maintaining low emission levels for $NO_x$ and $SO_x$.

Emissions of $N_2O$ by bubbling fluidized beds is not thought to be as significant a problem as with circulating fluidized beds, nonetheless bubbling fluidized beds are falling into disfavor because of problems with lowering $SO_x$ emissions to acceptable values.

SUMMARY OF THE INVENTION

It is, therefore, an object of the present invention to provide a method of operating a fluidized bed reactor in which emissions of $N_2O$ are lowered.

It is a still further object of the present invention to provide a method of operating a fluidized bed reactor in which the emissions of $N_2O$ are lowered while permitting sulfur capture by sorbent particles in the reactor.

It is a still further object of the present invention to provide a method of operating a fluidized bed reactor in which a temperature in an upper region of a furnace section is maintained substantially within a range of 1650° to 1800° F. for destroying $N_2O$ while permitting sulfur capture by sorbent particles.

It is a still further object of the present invention to provide a method of operating a fluidized bed reactor in which the temperature in the upper region is maintained by controlling the amount of particulate material entrained from a lower region of the furnace section to the upper region.

It is a still further object of the present invention to provide a method of operating a fluidized bed reactor in which emissions of $N_2O$, $SO_x$, and $NO_x$ are lowered simultaneously.

It is a still further object of the present invention to provide a method of operating a fluidized bed reactor in which emissions of $N_2O$, $NO_x$ and $SO_x$ are simultaneously lowered without the need for significant amounts of additional material or equipment which add to the cost and complexity of the reactor.

Toward the fulfillment of these and other objectives, the method of the present invention features a fluidized furnace section having a lower dense fluidized bed of particulate material, comprising nitrogen-containing carbonaceous fuel particles, sorbent particles, and solid products of combustion, and having an upper dispersed entrained bed of the particulate material. A lower region of the furnace section is operated under substoichiometric conditions so that combustion of the fuel particles is incomplete, to inhibit $N_2O$ and $NO_x$ formation. An upper region of the furnace section, above the substoichiometric lower region, is operated under oxidizing conditions to complete combustion of the fuel particles. The amount of particulate material in the upper region of the furnace section is controlled to maintain a temperature in the upper region which will destroy $N_2O$ formed during combustion. The temperature in the upper region is also preferably controlled to permit sulfur capture by the sorbent particles.

BRIEF DESCRIPTION OF THE DRAWING

The above brief description, as well as further objects, features, and advantages of the present invention will be more fully appreciated by reference to the following detailed description of the presently preferred but nonetheless illustrative embodiment in accordance with the present invention when taken in conjunction with the accompanying drawing which is a schematic view depicting a fluidized bed reactor which may be utilized in the process of the present invention.

DESCRIPTION OF THE PREFERRED EMBODIMENT

Referring to the drawing, the reference numeral 10 refers in general to a fluidized bed reactor used for the generation of steam. The reactor 10 includes an enclosure 12 having a front wall 14A, a spaced, parallel rear wall 14B, two spaced side walls (not shown) which extend perpendicular to the front and rear walls, a roof 16, and a floor 18, which together form a substantially rectangular enclosure.

A lower portion of the enclosure 12 is divided by a perforated distribution plate 20 into an upper furnace section 22 and a lower plenum chamber 24. The distribution plate 20 is suitably supported at the lower portion of the enclosure 12 and supports a bed of particulate material which may include nitrogen-containing carbonaceous fuel particles, such as coal, for combustion; sorbent particles, typically a calcium-containing sulfur acceptor such as limestone, lime, or dolomite, for the capture of $SO_x$ released during combustion of the fuel particles; and solid products of combustion.

The plenum chamber 24 receives a primary pressurized oxygen-containing gas such as air from a conventional, suitable source (not shown), such as a forced-draft blower or the like. The primary gas introduced into the plenum chamber 24 passes in an upward direction through the distribution plate 20 to support combustion and fluidize the particulate material in the furnace section 22.

A drain pipe 26 registers with an opening in the distribution plate 20 and extends through the plenum chamber 24 for discharging spent and unspent particulate material from the furnace section 22, for reasons to be described.

Conduits 28 and 30 supply particulate fuel and sorbent particles to the furnace section 22. It is understood that any number of arrangements for providing fuel and sorbent particles to the furnace section 22 of the enclosure 12 may be used. Examples of a few arrangements that may be used are disclosed in U.S. Pat. No. 4,936,770, assigned to the assignee of the present invention, the disclosure of which is hereby incorporated by reference.

At least one port 32 is provided through the walls of the enclosure 12 at a predetermined level to introduce a secondary oxygen-containing gas such as air into the furnace section 22, for reasons to be described. It is understood that additional ports (not shown) may be provided through the walls of the enclosure 12 at one or more levels or that other conventional means of introducing a secondary gas into the furnace section may be used.

A cyclone separator 34 extends adjacent the enclosure 12 and is connected thereto via a duct 36 extending from an outlet provided in an upper portion of the rear wall 14B of the enclosure 12 to an inlet provided through the separator wall. The lower portion of the separator 34 includes a hopper section 38 which is connected to a diverter device, or valve, 40 having a recycle conduit 42 and an extraction conduit 44 extending therefrom. The recycle conduit 42 extends through a lower portion of the rear wall 14B of the enclosure 12, and the extraction conduit 44 is adapted for connection to external equipment (not shown). The valve 40 operates in a conventional manner to vary the proportional flow of separated particulate material between the conduits 42 and 44, as will be described below.

The separator 34 receives flue gases and entrained particulate material from the furnace section 22 and operates in a conventional manner to disengage the entrained particulate material from the flue gases. The separated particulate material falls to the hopper section 38 of the separator 34 and passes to the valve 40 for being directed to the recycle conduit 42 and the extraction conduit 44. Although reference is made to one separator 34, it is understood that one or more additional separators (not shown) may be used with the reactor 10. The number and size of separators 34 used is determined by the capacity of the steam generator and economic considerations.

The separated flue gases, which are substantially free of particulate material, pass via a duct 46, located immediately above the separator 34, into a heat recovery section shown in general by the reference numeral 48. A plurality of heat exchange surfaces 50A, 50B, 50C are disposed in the heat recovery section 48, all of which are formed by a plurality of heat exchange tubes which extend in the path of the separated flue gases as the separated flue gases pass through the heat recovery section 48. The heat exchange surfaces 50A, 50B, 50C may serve as reheaters, superheaters, economizers, or the like, as desired. After passing across the heat exchange surfaces 50A, 50B, 50C, the separated flue gases exit the heat recovery section 48 through outlet 52.

The walls of the enclosure 12, the separator 34, and the heat recovery section 48 are formed by a plurality of vertically extending, spaced, parallel tubes interconnected by fins to form contiguous airtight structures. Portions of the finned tubes are shown schematically in the drawing, shown in general by the reference numeral 54, but since this type of structure is conventional, it will not be shown or described in further detail. The ends of each of these finned tubes 54 are connected to a plurality of horizontally disposed upper and lower headers 56 and 58, respectively.

A steam drum 60 is located above the enclosure 12, the separator 34, and the heat recovery section 48. The steam drum 60 receives a cooling fluid such as water from a feed pipe (not shown), and a plurality of downcomers 62, and pipes 64, 66 extend from the steam drum 60 and are utilized, along with connecting feeders, risers, headers, etc., to establish a fluid flow circuit which includes the finned tubes 54 forming the aforementioned walls and the heat exchange surfaces 50A, 50B, 50C in the heat recovery section 48. Water may be passed in a predetermined sequence through this fluid flow circuitry to convert the water to steam and to heat the steam with the heat generated by the combustion of the fuel particles.

In operation, nitrogen-containing carbonaceous fuel particles, such as coal, and sorbent particles, typically a calcium-containing sulfur acceptor such as limestone, lime, or dolomite, are introduced into the furnace section 22 via conduits 28 and 30. A primary, oxygen-containing gas, such as air, from an external source is introduced at a relatively high pressure into the plenum chamber 24 and is passed upwardly through the distribution plate 20 at a relatively high fluidizing velocity to fluidize the particulate material in the furnace section 22. A light-off burner (not shown) or the like ignites the fuel particles, and thereafter the fuel particles are self-combusted by the heat in the furnace section 22, thereby generating gaseous and solid products of combustion.

The fluidizing velocity of the primary air is then controlled to maintain a dense bed of particulate material in a lower portion of the furnace section 22 and to pass or entrain an amount of the particulate material upwardly from the dense bed to form a dispersed bed above the dense bed. The dispersed bed includes a solids reflux region, which is located immediately above the dense bed and which may extend several feet above the dense bed, and a pneumatic transport region, which is located above the solids reflux region and which extends upwardly to the roof 16 of the enclosure 12.

The solids reflux region has significant portions of particulate material passing upwardly and downwardly across the region. A first portion of the entrained particulate material in the solids reflux region is pneumatically transferred by the primary gas upwardly through the solids reflux region and into the pneumatic transport region, whereas a second portion of the particulate material in the solids reflux region is disengaged from the primary gas and falls back to the dense bed. In contrast, in the pneumatic transport region, substantially all of the entrained particulate material remains entrained and passes upwardly through the region to be discharged as described below.

The amount of oxygen supplied by the primary air is maintained below the theoretical amount of oxygen required for complete combustion of the fuel particles in a lower region, so the lower region of the furnace section 22 is operated under fuel rich or substoichiometric conditions in which combustion of fuel particles is incomplete. Operating under such substoichiometric conditions in the lower region inhibits formation of $NO_x$ and $N_2O$.

A secondary, or overfire, oxygen-containing gas, preferably air, is introduced into the furnace section 22 through the port 32. The secondary gas is preferably introduced into the furnace section 22 at a level above the dense bed and more preferably at a level immediately above the solids reflux region, for reasons to be described.

The amount of oxygen supplied by the secondary gas is maintained above the theoretical amount of oxygen required for complete combustion so that oxidizing conditions are maintained in the furnace section 22 from at or near the level at which the secondary gas is introduced into the furnace section 22 via the port 32 to the roof 16 of the enclosure 12. It is understood that the upper region is the region in the furnace section 22 from at or near the level at which the secondary gas is introduced into the furnace section 22 via the port 32 to the roof 16 of the enclosure 12. Enough oxygen is supplied by the secondary gas so that combustion of the fuel particles is substantially complete in the upper region.

The secondary gas mixes with the primary gas and gaseous products of combustion to form flue gases which pass upwardly through the upper region of the furnace section 22 with the entrained particulate material, and the flue gases and at least a portion of the entrained particulate material is discharged from the furnace section 22 to the separator 34 via duct 36. The discharged particulate material is separated from the flue gases in the separator 34 and is passed through the valve 40 which may be adjusted to vary the relative proportions of the separated particulate material entering the recycle conduit 42 and the extraction conduit 44 and, therefore, to vary the amounts of the separated particulate material being reintroduced into the furnace section 22, for reasons to be described.

The recycle conduit 42 preferably reintroduces the separated particulate material into the lower region of the furnace section 22. The operation of the valve 40 is further described in U.S. Pat. No. 4,809,623, assigned to the assignee of the present invention, the disclosure of which is incorporated herein by reference.

The separated flue gases exit the separator 34 via the duct 46 and pass to a heat recovery section 48. In the heat recovery section 48, the separated flue gases pass through the heat exchange surfaces 50A, 50B, 50C before exiting via outlet 52.

Water is passed through the feed pipe to the steam drum 60 and is then passed through the fluid flow circuit so that the heat generated by combustion is used to convert the water to steam and to superheat the steam.

Circulating fluidized beds are typically operated to avoid temperature excursions within the furnace section. This is often accomplished using relatively high internal and external recycling of particulate material which renders the furnace section insensitive to fuel heat release patterns, thereby minimizing temperature variations within the furnace section. In contrast, it has been discovered that temperature excursions resulting in increased temperatures in the upper region of a furnace section 22 are useful for destroying $N_2O$ formed during combustion. Therefore, according to a feature of the present invention, temperature excursions are created and maintained within the furnace section 22 in simple, efficient, and inexpensive manners.

More particularly, according to the present invention, the lower region of the furnace section 22 is maintained at a relatively low temperature, preferably below 1600° F., to inhibit the formation of $NO_x$ and $N_2O$ while a relatively high temperature, substantially within the range of 1650°–1800° F., is created and maintained in the upper region of the furnace section 22 to further lower $N_2O$ emissions. In normal operation, the temperature in the upper region will reach its maximum value at or near the level at which the secondary air is introduced into the furnace section 22 via the port 32 and will thereafter decrease upwardly across the upper region. References to creating or maintaining a particular temperature in the upper region will refer to the maximum temperature achieved in the upper region, which will typically occur at or near the level at which the secondary air is introduced into the furnace section 22 via the port 32.

Although it is preferred to maintain the temperature in the upper region at approximately 1800° F. to minimize emissions of $N_2O$, it will become impractical to maintain this temperature in the upper region as the load on the reactor 10 decreases. However, temperatures in the upper region substantially within the range of 1650°-1800° F. will nonetheless provide satisfactory lowering of $N_2O$ emissions in the upper region without significantly harming sulfur capture since this temperature range is sufficiently high to destroy $N_2O$ yet sufficiently low to permit sulfur capture by the sorbent particles. Operating under these conditions will still permit efficient sulfur capture such that sulfur retention of approximately 90% or better may be obtained with a supply of sorbent particles sufficient to maintain a Ca/S molar ratio substantially within the range of 2:1 to 3:1. Higher temperatures are avoided because, at higher temperatures, the sulfates formed during sulfur capture tend to decompose back to $SO_x$. Thermal $NO_x$ also tends to form at higher temperatures due to the burning of the nitrogen in the air.

The relatively high temperature, substantially within the range of 1650°-1800° F., is maintained in the upper region of the furnace section 22 by controlling the amount of particulate material in the upper region of the furnace section. Particulate material in the upper region absorbs heat released by combustion thereby tending to lower the temperature in that region. For example, operating the furnace section 22 so that there is a relatively large amount of particulate material in the upper region, as is typically done in circulating fluidized bed reactors, tends to drive down the temperature in the upper region and tends to create a relatively uniform temperature across the furnace section. Conversely, if the furnace section is operated so that there is a relatively small amount of particulate material in the upper region (i.e., so that there is less particulate material in the upper region to absorb heat released by combustion in the upper region), the temperature in the upper region will increase substantially.

Therefore, by controlling the amount of particulate material in the upper region of the furnace section, one can control the temperature obtained in the upper region. Because the upper region begins at or near the level at which the secondary gas is introduced, and because it is desirable to maintain a relatively small amount of particulate material in the upper region for maintaining the desired temperature, the secondary gas is preferably introduced at a level above the dense bed and more particularly at a level above the solids reflux region. As mentioned earlier, the solids reflux region has a significant portion of particulate material passing downwardly across the region and returning to the dense bed. This falling particulate material carries with it heat absorbed in the solids reflux region and, therefore, tends to decrease temperatures obtained in that region.

According to the present method, the temperature in the upper region is controlled by controlling the amount of particulate material in the upper region of the furnace section 22, which is in turn controlled by controlling the amount of particulate material entrained or passed from the lower region to the upper region of the furnace section. This may be accomplished in a number of ways, a few of which are described below. For example, the fluidizing velocity of the primary gas may be controlled to control the amount of particulate material which passes from the lower region to the upper region of the furnace section. Increasing the fluidizing velocity will drive more particulate material from the lower region to the upper region and will thereby tend to decrease the temperature obtained in the upper region. Decreasing the fluidizing velocity will have the opposite effect.

The amount of particulate material which passes from the lower region to the upper region may also be controlled by controlling the size distribution of the particulate material in the lower region. For example, the particulate material in the lower region of the furnace section will be present in a ratio of relatively fine to relatively coarse particulate material, and the amount of particulate material which passes from the lower region to the upper region of the furnace section can be controlled by controlling the ratio of relatively fine to relatively coarse particulate material in the lower region.

More particularly, for any given fluidizing velocity of primary gas, if the ratio of relatively fine to relatively coarse particulate material in the lower region increases, the amount of particulate material which passes from the lower region to the upper region of the furnace section will also increase, thus lowering the temperature in the upper region. Decreasing the ratio of relatively fine to relatively coarse particulate material in the lower region will have the opposite effect.

The ratio of relatively fine to relatively coarse particulate material in the lower region of the furnace section 22 may also be controlled in a number of ways. For example, since proportionately more relatively coarse particulate material and less relatively fine particulate material will be present in a lower portion of the dense bed, draining particulate material from a lower portion of the dense bed will tend to remove proportionately more relatively coarse particulate material than relatively fine particulate material, thereby increasing the ratio of relatively fine to relatively coarse particulate material in the lower region. Therefore, increasing the amount of particulate material drained from a lower portion of the dense bed via the drain 26 may be used to increase the ratio of relatively fine to relatively coarse particulate material in the lower region of the furnace section, thereby increasing the amount of particulate material which is passed from the lower region to the upper region and, in turn, decreasing the temperature in the upper region. Decreasing the amount of particulate material drained from the drain 26 will have the opposite effect.

The ratio of relatively fine to relatively coarse particulate material in the lower region of the furnace section 22 may also be controlled by controlling the amount of particulate material recycled to the lower region of the furnace section 22 via the separator 34. The ratio of relatively fine to relatively coarse particulate material for the portion of the entrained particulate material discharged from the upper region of the furnace section 22 into the separator 34 will be substantially higher than the ratio of relatively fine to relatively coarse particulate material in the lower region. Accordingly, the ratio of relatively fine to relatively coarse particulate material in the lower region may be controlled by controlling the amount of separated particulate material returned from the separator 34 to the lower region of the furnace section 22. To this end, the valve 40 may be used to control the proportionate flow of separated particulate material to the recycle conduit 42 and the extraction conduit 44, thereby controlling the amount of separated particulate material returned from the separator 34 to the lower region of the furnace section 22.

More particularly, increasing the amount of separated particulate material returned from the separator 34 to the lower region of the furnace section 22 will increase the ratio of relatively fine to relatively coarse particulate material in the lower region. This will increase the amount of particulate material which is passed from the lower region to the upper region and will, in turn, decrease the temperature in the upper region. Decreasing the amount of separated particulate material returned from the separator 34 to the lower region of the furnace section 22 will have the opposite effect.

The ratio of relatively fine to relatively coarse particulate material in the lower region of the furnace section 22 may also be controlled by controlling the size of additional fuel and sorbent particles which are fed into the furnace section via conduits 28 and 30, respectively, to replenish spent and unspent fuel and sorbent particles. The additional fuel and sorbent particles fed into the furnace section have predetermined sizes which may be changed as desired so that the additional fuel or sorbent particles fed into the furnace section 22 are larger or smaller than the original predetermined sizes.

More particularly, decreasing the size of additional sorbent particles fed into the furnace section via the conduit 30 will increase the ratio of relatively fine to relatively coarse particulate material in the lower region, leading to an increase in the amount of particulate material passed from the lower region to the upper region and, in turn, to a decrease of the temperature in the upper region. Increasing the size of the additional sorbent particles fed into the furnace section 27 via the conduit 30 will have the opposite effect.

Similarly, the size of the additional fuel particles fed into the furnace section 22 via the conduit 28 may be decreased or increased as desired, thereby tending to decrease or increase the temperature in the upper region.

In addition to lowering emissions of $N_2O$ by maintaining a relatively high temperature in the upper region, the amount of $N_2O$ formed in the lower region may be decreased by increasing the amount of carbonaceous material in the lower region of the furnace section. When the additional fuel particles are fed into the furnace section 22 via the conduit 28 under the reducing conditions prevailing in the lower region, the additional fuel particles release combustible gases and are thereby devolatilized, leaving carbonaceous material in the lower region. The presence of carbonaceous material in the lower region inhibits formation of $NO_x$ and $N_2O$ in the lower region.

Increasing the amount of carbonaceous material in the lower region of the furnace section therefore acts to decrease emissions of $N_2O$. In this regard, the amount of carbonaceous material present in the lower region of the furnace section may be increased by maintaining the fluidizing velocity of the primary gas constant while temporarily increasing the amount of additional fuel particles fed into the furnace section. In this manner, the emissions of $N_2O$ may be further controlled.

Several advantages result from the foregoing method. For example, the emissions of $N_2O$, $SO_x$, and $NO_x$ are lowered simultaneously. Additionally, $N_2O$ emissions are controlled and lowered in a simple, efficient, and inexpensive manner by controlling the amount of particulate material passing from the lower region of the furnace section 22 to the upper region of the furnace section 22. Further, $N_2O$ emissions are also lowered by increasing the amount of carbonaceous material in the lower region of the furnace section. The emissions of $N_2O$, $SO_x$ and $NO_x$ are thereby lowered simultaneously without the need for significant amounts of additional material or equipment which add to the cost and complexity of the reactor.

It is understood that variations may be made in the method of the present invention without departing from the scope of the invention. For example, although it is preferred to introduce the secondary gas into the furnace section 22 at a level above the solids reflux region, it is understood that the secondary gas may be introduced at any number of levels in the furnace section and at more than one level in the furnace section. Additionally, the valve 40 need not be used in connection with the separator 34, and the separator may instead return all or none of the separated particulate material to the furnace section 22. Further, the separator 34 may return separated particulate material to the furnace section 22 in more than one location and at more than one level. The fluid flow circuitry may also use natural or forced circulation.

Other modifications, changes, and substitutions are intended in the foregoing disclosure and, in some instances, some features of the invention can be employed without a corresponding use of other features. Various modifications to the disclosed embodiment as well as alternative applications of the invention will be suggested to persons skilled in the art by the foregoing specification and drawing. Accordingly, it is appropriate that the appended claims be construed broadly and in a manner consistent with the scope of the invention therein.

What is claimed is:

1. A method of operating a fluidized bed reactor to simultaneously lower emissions of $N_2O$, NOx and SOx comprising:

(a) providing a furnace section having a bed of particulate material comprising nitrogen-containing fuel particles for combustion and sorbent particles for sulfur capture;

(b) introducing a primary, oxygen-containing gas into said lower region at a fluidizing velocity sufficient to fluidize said particulate material;

(c) operating a lower region of said furnace section under substoichiometric conditions such that combustion of said fuel particles is incomplete;

(d) operating an upper region of said furnace section above said lower region under oxidizing conditions to complete combustion of said fuel particles in said upper region; and (e) maintaining said lower region at a temperature below approximately 1600° F. to lower emissions of NOx; and (f) controlling said fluidizing velocity to control passage of said particulate material from said lower region to said upper region to maintain a temperature substantially within a range of 1650° to 1800° F. in said upper region for lowering emissions of $N_2O$ formed during combustion while permitting efficient sulfur capture to lower emissions of SOx.

2. The method of claim 1 wherein said temperature in said upper region is approximately 1800° F.

3. The method of claim 2 wherein said amount of said particulate material in said upper region is controlled by decreasing said amount of said particulate material in said upper region in response to a decrease in said temperature in said upper region below approximately 1800° F.

4. A method of operating a fluidized bed reactor to simultaneously lower emissions of $N_2O$, NOx and SOx comprising:

(a) providing a furnace section having a bed of particulate material comprising nitrogen-containing fuel particles for combustion and sorbent particles for sulfur capture;

(b) introducing a primary, oxygen-containing gas into said lower region at a fluidizing velocity sufficient to fluidize said particulate material;

(c) operating a lower region of said furnace section under substoichiometric conditions such that combustion of said fuel particles is incomplete;

(d) operating an upper region of said furnace section above said lower region under oxidizing conditions to complete combustion of said fuel particles in said upper region; and (e) maintaining said lower region at a temperature below approximately 1600° F. to lower emissions of NOx; and (f) passing said particulate material from said lower region to said upper region; and (g) controlling the ratio of relatively five particulate material to relatively coarse particulate material passed from said lower region to said upper region to maintain a temperature substantially within a range of 1650° to 1800° F. in said upper region for lowering emissions of $N_2O$ formed during combustion while permitting efficient sulfur capture to lower emissions of SOx.

5. The method of claim 4 further comprising draining a portion of said particulate material from a lower portion of said lower region; and wherein said ratio of relatively fine to relatively coarse particulate material in said lower region is controlled by controlling said drainage of said particulate material.

6. The method of claim 4 wherein said furnace section is fluidized by a primary, oxygen-containing gas; and said upper region of said furnace section is operated under oxidizing conditions by introducing a secondary, oxygen-containing gas into said furnace section above said lower region, said primary gas and said secondary gas combining to form flue gases which entrain a portion of said particulate material in said furnace section; and further comprising discharging said flue gases and said entrained particulate material from said upper region;

separating said discharged particulate material from said discharged flue gases;

reintroducing a portion of said separated particulate material into said lower region of said furnace section; and wherein said ratio of relatively fine to relatively coarse particulate material in said lower region of said furnace section is controlled by controlling said portion of said separated particulate material which is reintroduced into said lower region.

7. The method of claim 4 further comprising introducing additional sorbent particles to said furnace section to replenish said sorbent particles; and wherein said ratio of relatively fine to relatively coarse particulate material in said lower region is controlled by controlling the size of said additional sorbent particles.

8. The method of claim 4 further comprising introducing additional fuel particles to replenish said fuel particles; and wherein said ratio of relatively fine to relatively coarse particulate material in said lower region is controlled by controlling the size of said additional fuel particles.

9. A method of operating a fluidized bed reactor to simultaneously lower emissions of $N_2O$, NOx and SOx comprising:

(a) providing a furnace section;

(b) introducing nitrogen-containing fuel particles for combustion and sorbent particles for sulfur capture into said furnace section;

(c) combusting said fuel particles to form gaseous and solid products of combustion, said solid products of combustion mixing with said fuel particles and said sorbent particles to form particulate material;

(d) introducing a primary oxygen-containing gas into a lower region of said furnace section at a first level to support combustion of said fuel particles and to fluidize said particulate material to form a lower dense bed of said particulate material and an upper dispersed bed of said particulate material above said dense bed;

(e) operating said lower region at substoichiometric conditions so that said combustion of said fuel particles is incomplete;

(f) maintaining said lower region at a temperature below approximately 1600° F. to lower emissions of NOx;

(g) introducing a secondary oxygen-containing gas into said furnace section at a second level above said first level to create oxidizing conditions in said upper region of said furnace section;

(h) passing said particulate material from said lower region to said upper region; and (i) controlling the ratio of relatively fine to relatively coarse particulate material passed from said lower region to said upper region to maintain a temperature substantially within a range of 1650° F. to 1800° F. in said upper region for destroying $N_2O$ while permitting efficient sulfur capture to lower emissions of SOx.

10. The method of claim 9 wherein said primary gas is introduced at a fluidizing velocity; and said passage of said particulate material from said lower region to said upper region is controlled by controlling said fluidizing velocity of said primary gas.

11. The method of claim 9 further comprising draining a portion of said particulate material from a lower portion of said lower region; and wherein said ratio of relatively fine to relatively coarse particulate material in said lower region is controlled by controlling said drainage of said particulate material.

12. The method of claim 9 wherein said primary gas, said secondary gas, and said gaseous products of combustion combine in said furnace section to form flue gases which entrain a portion of said particulate material in said furnace section; and further comprising discharging a portion of said flue gases and said entrained particulate material from said upper region;

separating said discharged particulate material from said discharged flue gases;

dividing said separated particulate material into a first portion and a second portion; and returning said first portion to said lower region of said furnace section.

13. The method of claim 12 wherein said ratio of relatively fine to relatively coarse particulate material in said lower region is controlled by controlling said first portion of said separated particulate material which is returned to said lower region.

14. The method of claim 13 further comprising passing said second portion of said separated particulate material to external equipment.

15. The method of claim 9 wherein said dispersed bed comprises a solids reflux region above said dense bed and a pneumatic transport region above said solids reflux region; and said second level at which said secondary gas is introduced into said furnace section is above said solids reflux region.

16. The method of claim 9 wherein said second temperature is maintained at substantially said level at which said secondary gas is introduced into said furnace section.

17. The method of claim 9 wherein said fuel particles are devolatilized in said lower region to form carbonaceous material in said lower region; and further comprising controlling said carbonaceous material in said lower region to inhibit formation of $N_2O$.

18. The method of claim 17 wherein said fuel particles are introduced into said furnace section at a predetermined rate;

said primary gas is introduced into said furnace section at a fluidizing velocity; and said carbonaceous material in said lower region is controlled by maintaining said fluidizing velocity of said primary gas constant while said rate at which said fuel particles are introduced is temporarily increased to increase said carbonaceous material in said lower region.

19. The method of claim 9 wherein said temperature in said upper region is approximately 1800° F.

20. The method of claim 19 wherein said amount of said particulate material in said upper region is controlled by increasing said amount of said particulate material in said upper region in response to an increase in said second temperature above approximately 1800° F.

21. A method of operating a fluidized bed reactor to simultaneously lower emissions of $N_2O$, NOx and SOx comprising:

(a) providing a furnace section having a bed of particulate material in a lower region which contains nitrogen-containing fuel particles for combustion and sorbent particles for sulfur capture;

(b) introducing a primary, oxygen-containing gas into said lower region of said furnace to fluidized said bed of particulate material, a portion of said particulate material passing from said lower region of said furnace to an upper region thereof;

(c) maintaining said lower region at a temperature below approximately 1600° F. to lower emissions of NOx; and (d) controlling the ratio of relatively fine to relatively coarse particulate material passed from said lower region to said upper region to maintain a predetermined temperature in said upper region for reducing emissions of $N_2O$ formed during combustion while permitting efficient sulfur capture to lower SOx emissions.

22. The method of claim 21 further comprising operating said lower region of said furnace section under substoichiometric conditions such that combustion of said fuel particles is incomplete; and operating said upper region of said furnace section above said lower region under oxidizing conditions to complete combustion of said fuel particles.

23. The method of claim 21 wherein said amount of said particulate material in said upper region is controlled by controlling passage of said particulate material from said lower region to said upper region.

24. The method of claim 21 wherein said primary gas is introduced into said lower region at a fluidizing velocity; and said passage of said particulate material from said lower region to said upper region is controlled by controlling said fluidizing velocity.

25. The method of claim 45 further comprising draining a portion of said particulate material from a lower portion of said lower region; and wherein said ratio of relatively fine to relatively coarse particulate material in said lower region is controlled by controlling said drainage of said particulate material.

26. The method of claim 21 wherein said upper region of said furnace section is operated under oxidizing conditions by introducing a secondary, oxygen-containing gas into said furnace section above said lower region, said primary gas and said secondary gas combining to form flue gases which entrain a portion of said particulate material in said furnace section; and further comprising discharging said flue gases and said entrained particulate material from said upper region;

separating said discharged particulate material from said discharged flue gases;

reintroducing a portion of said separated particulate material into said lower region of said furnace section; and wherein said ratio of relatively fine to relatively coarse particulate material in said lower region of said furnace section is controlled by controlling said portion of said separated particulate material which is reintroduced into said lower region.

27. The method of claim 21 further comprising introducing additional sorbent particles to said furnace section to replenish said sorbent particles; and wherein said ratio of relatively fine to relatively coarse particulate material in said lower region is controlled by controlling the size of said additional sorbent particles.

28. The method of claim 21 further comprising introducing additional fuel particles to replenish said fuel particles; and wherein said ratio of relatively fine to relatively coarse particulate material in said lower region is controlled by controlling the size of said additional fuel particles.

29. The method of claim 21 wherein said temperature in said upper region is approximately 1800° F.

30. The method of claim 29 wherein said amount of said particulate material in said upper region is controlled by decreasing said amount of said particulate material in said upper region in response to a decrease in said second temperature below approximately 1800° F. and increasing said amount of said particulate material in said upper region in response to an increase in said second temperature above approximately 1800° F.

* * * * *

UNITED STATES PATENT AND TRADEMARK OFFICE

CERTIFICATE OF CORRECTION

PATENT NO. : 5,325,796

DATED : July 5, 1994

INVENTOR(S) : Juan A. Garcia-Mallol

It is certified that error appears in the above-indentified patent and that said Letters Patent is hereby corrected as shown below:

Claim 4, column 11, line 33, change "five" to --fine--.

Signed and Sealed this

Twenty-fifth Day of October, 1994

*Attest:*

*Attesting Officer*

Bruce Lehman

BRUCE LEHMAN

*Commissioner of Patents and Trademarks*